US009129714B2

(12) United States Patent
Noonan et al.

(10) Patent No.: US 9,129,714 B2
(45) Date of Patent: Sep. 8, 2015

(54) ELECTRON LINAC FOR MEDICAL ISOTOPE PRODUCTION WITH IMPROVED ENERGY EFFICIENCY AND ISOTOPE RECOVERY

(75) Inventors: John Noonan, Naperville, IL (US); Dean Walters, Naperville, IL (US); Matt Virgo, Chicago, IL (US); John Lewellen, Seaside, CA (US)

(73) Assignee: UChicago Argonne, LLC, Chicago, IL (US)

( * ) Notice: Subject to any disclaimer, the term of this patent is extended or adjusted under 35 U.S.C. 154(b) by 818 days.

(21) Appl. No.: 13/248,209

(22) Filed: Sep. 29, 2011

(65) Prior Publication Data

US 2013/0083880 A1 Apr. 4, 2013

(51) Int. Cl.

| | |
|---|---|
| ***G21G 1/10*** | (2006.01) |
| ***H05H 9/00*** | (2006.01) |
| ***H05H 7/02*** | (2006.01) |

(52) U.S. Cl.

CPC . *G21G 1/10* (2013.01); *H05H 7/02* (2013.01); *H05H 9/00* (2013.01)

(58) Field of Classification Search

CPC ..... G21G 1/00–1/12
USPC ..... 376/156, 190
See application file for complete search history.

(56) References Cited

U.S. PATENT DOCUMENTS

| | | | | |
|---|---|---|---|---|
| 6,155,973 | A | 12/2000 | Howes et al. | |
| 6,844,688 | B1 * | 1/2005 | Williams et al. | 315/505 |
| 6,906,478 | B2 * | 6/2005 | Hajima et al. | 315/503 |
| 2005/0175042 | A1 * | 8/2005 | Hajima | 372/2 |

OTHER PUBLICATIONS

A.N. Dovbnya, V.I. Nikiforov, V.L. Uvarov, V.F. Zhyglo, "Optimization of Electron Linac Operating Conditions for Photonuclear Isotope Production," European Particle Accelerator Conference, Genoa, Italy, 2008.*

A.N. Dovbnya, G.P. Kovtun, A.V. Torgovkin, V.L. Uvarov, B.I. Shramenko, "Estimation of Os, Ir, Sc, in Isotope Production at Electron Linear Accelerators," Problems of Atomic Science and Technology 2006, #3 (Series Nuclear Physics Investigations 47, pp. 168-170).

V.I. Nikiforov, V.L. Uvarov, "Estimation of the Photonuclear Yield in Production Targets," Radiochemistry 52, #3, (2010).

Y.D. Tur, "Linear Electron Accelerator for the Medical Isotope Production," European Particle Accelerator Conference, Vienna, Austria, 2000.

http://www.mipodnuclear.com/html/download_specs.html.

http://www.accsys.com/products/pulsar.html.

D. H. Bilderback et al, "Energy recovery linac (ERL) coherent hard x-ray," New Journal of Physics 12 (2010) 03501.

(Continued)

*Primary Examiner* — Jack W Keith
*Assistant Examiner* — Marshall O'Connor
(74) *Attorney, Agent, or Firm* — Joan Pennington

(57) ABSTRACT

A method and isotope linac system are provided for producing radio-isotopes and for recovering isotopes. The isotope linac is an energy recovery linac (ERL) with an electron beam being transmitted through an isotope-producing target. The electron beam energy is recollected and re-injected into an accelerating structure. The ERL provides improved efficiency with reduced power requirements and provides improved thermal management of an isotope target and an electron-to-x-ray converter.

15 Claims, 6 Drawing Sheets

(56) References Cited

OTHER PUBLICATIONS

X-ray sources I. Ben-Zvi et al, "Electron Cooling of RHIC," Proceedings of the 2005 Particle Accelerator Conference, Knoxville, TN.

Andrew Hutton, "Push-Pull FEL, a new ERL concept," NIM A 557, pp. 220-223 (2006).

L.I. Schiff, "Energy-Angle Distribution of Thin Target Bremsstrahlung," Physical Review 83, 252 (1951.

H. A. Bethe and J. Ashkin, Chapter 2 of Experimental Nuclear Physics, edited by E. Sergé, (John Wiley & Sons, New York 1953).

M.J. Berger and S.M. Seltzer, "Bremsstrahlung and photoneutrons from thick tungsten and tantalum targets," Phys. Rev. C 2, 621 (1970).

M. Mirea, O. Bajeat, F. Clapier, S. Essabaa, L. Groza, F. Ibrahim, S. Kandri-Rody, A.C. Mueller, N. Pauwels, J. Proust, "Exploratory analysis of a neutron-rich nuclei source based on photo-fission," Nucl. Instr. and Meth. B 201, 433 (2003).

15. Making Medical Isotopes: Report of the Task Force on Alternatives for Medical-Isotope Production, TRIUMF (2008), http://www.triumf.ca/sites/defaultifiles/Making Medical Isotopes PREPUB.pdf.

Lia Merminga, David R. Douglas, and Geoffrey A. Krafft, "High-Current Energy-Recovering Electron Linacs" Annual Review of Nuclear and Particle Science, vol. 53: 387-429 (Dec. 2003).

* cited by examiner

ELECTRON LINAC FOR MEDICAL ISOTOPE PRODUCTION WITH IMPROVED ENERGY EFFICIENCY AND ISOTOPE RECOVERY

CONTRACTUAL ORIGIN OF THE INVENTION

The United States Government has rights in this invention pursuant to Contract No. DE-AC02-06CH11357 between the United States Government and UChicago Argonne, LLC representing Argonne National Laboratory.

FIELD OF THE INVENTION

The present invention relates generally to the field of medical radio-isotope producing such as $^{99}$Mo, $^{67}$Cu and others, and more particularly, relates to a method and an improved electron linear accelerator for producing radio-isotopes; and more specifically, relates to an energy recovery linear accelerator used to produce radio-isotopes and to recover the isotopes in a continuous process.

DESCRIPTION OF THE RELATED ART

Isotope Production

Radio-isotopes are used extensively for imaging and treatment of a variety of medical problems. Radio-isotopes can occur naturally due to radioactive decay of heavy atoms, such as $^{235}$U or $^{239}$Pu. However, the quantity of isotopes is insufficient to meet today's demand for medical applications. Nuclear reactors are the most productive source of isotopes because the reactor increases the fission reaction. A major drawback of reactors is the use of highly enriched $^{235}$U (HEU). There is a significant operating burden to control the HEU to prevent nuclear proliferation. Until recently the cost of building a reactor could not be recovered simply by commercialization of medical isotopes.

Proton and heavy ion cyclotrons and linear accelerators (linacs) are the next largest source for making isotopes. The proton/heavy ion linacs and cyclotrons are also expensive, complex systems that require significant capital investment, operating cost, and regularity oversight. Extended operation of high-current proton accelerators can lead to the accelerators themselves becoming radioactive, through interaction of the accelerator with scattered, or "lost," high-energy protons.

Electron linacs with beam energies of ~50 MV and 10 kW of power are also used to produce selected isotopes, such as $^{99}$Mo, $^{131}$I, and $^{67}$Cu. The most active research in electron linacs is performed at the Kharkov Institute of Physic and Technology (KIPT), Karkov, Ukraine.

Fast Neutron Generator for Isotope Production

MiPod Nuclear is a start-up company that is developing a prototype system to produce $^{99}$Mo isotopes using fast neutron irradiation of depleted $^{238}$U. The design specification is a spherical enclosure of ~6' radius. The fast neutron generator is specified to create $3.5\times10^{13}$ 14.6 MeV neutrons per second. The neutrons produce a fission reaction in a $^{238}$U bed. Approximately 6% of the fission products are $^{99}$Mo.

Proton Linacs

Proton linacs that produce 7 to 40 MV proton beams are commercially available, such as from AccSys. Protons are very effective in producing radio-isotopes, but the linacs are expensive, and therefore, limited in number.

Electron Linacs

Electron linacs are being used to produce radio-isotopes at the Kharkov Institute of Physics and Technology (KIPT), Kharkov, Ukraine. A modern isotope target receives the electron beam exit window and photon converters. The state-of-the-craft system is composed of a cathode, RF electron gun, focusing elements to match the electron beam with an accelerating structure that creates a ~50 MV electron beam that is transmitted through a vacuum window into a high atomic mass material to create γ-rays through bremsstrahlung scatter. The γ-rays then strike a target to create isotopes. The KIPT linac is a copper structure, which limits the beam power to ~10 kW. There are proposals to use superconducting RF structures to increase the power to ~100 kW.

The state-of-the-craft linacs have several technical limits that prevent increasing the isotope production for a given electron linac. For example, the existing technology limits how much additional beam power can be added to increase capacity. The amount of heat deposited into target would approach 500 kilowatts for a 50 MV, 100 milliamp electron beam. The ability to cool the converter/target becomes increasingly unmanageable. The electron beam is accelerated by coupling RF power into the accelerating structures. The power couplers also are approaching their power limits for 100 mA beams. One way to overcome the power coupler limit is to increase the number of accelerating cavities, reducing the RF power per structure to manageable levels. However, this increases the length of the linac, which increases cost; the additional component count also adds costs and reduces reliability.

Energy Recovery Linacs (ERLs) have been used as the electron beam accelerator for a variety of photon sources. The Free Electron Laser (FEL) is the most common application. The FEL creates photons by passing a high energy electron beam through a periodic magnetic structure. The interaction generates a high intensity, coherent photon source but is inefficient, converting ~1% of the electron beam power into photons. Depending on the electron energy, the photon energy can be tuned from microwaves to x-rays. The ERL reduces the total external power required to power FELs. This is accomplished by recirculating the spent electron beam back into the accelerating structure at an RF phase delay that extracts power from the electron beam to store RF energy in the linac cavities. By selecting the proper phase advance, the incident electron beam draws power from the cavities to accelerate the incident beam to the desired energy. The energy recovery of the recirculated beam reduces the input RF power required to accelerate the electrons. A second ERL application is for electron cooling of high energy particle beams.

A need exists for an effective mechanism for producing radio-isotopes and recovering the isotopes. It is desirable to provide such mechanism that provides improved efficiency with reduced power requirements and that provides improved thermal management of an isotope target and an electron-to-x-ray converter.

SUMMARY OF THE INVENTION

Principal aspects of the present invention provide a method and energy recovery linac for producing radio-isotopes and recovering the isotopes in a continuous process. Other important aspects of the present invention are to provide such method and energy recovery linac substantially without negative effect and that overcome some of the disadvantages of prior art arrangements.

In brief, a method and isotope linac system are provided for producing radio-isotopes and for recovering isotopes. The isotope linac is an energy recovery linac (ERL) with an electron beam being transmitted through an isotope-producing target. The electron beam energy is recollected and re-injected into an accelerating structure.

In accordance with features of the invention, using the ERL reduces the effective operating voltage of the energy recovery linear accelerator, improves the efficiency of the machine by reducing the external power requirement for a selected electron beam power, and improves the thermal management of the isotope target and electron-to-x-ray converter.

In accordance with features of the invention, in one embodiment the ERL includes an electron gun, an accelerating structure, and target; and a beam lattice that recycles the spent beam to the entrance of the accelerating structure to recover the RF power.

In accordance with features of the invention, in the one embodiment with the recycled beam lattice a simple isotope target design is enabled. The target includes a single γ-ray converter and a thin isotope target. The single γ-ray converter has a thickness that is determined by the energy acceptance for the accelerating structure. The converter is just thick enough to create gamma radiation that is required for photo-fission of the target.

In accordance with features of the invention, in one embodiment the ERL includes an electron injector, an accelerating linac structure, and a target. The linac is followed by a second linac structure that decelerates the electron beam to recover the RF power. The RF is then transmitted to the accelerating linac. An advantage of this configuration is that the beam return lattice is eliminated.

In accordance with features of the invention, in one embodiment the ERL includes a pair of electron guns and a pair of accelerating linacs that are in-line, with one linac is injecting spent beam into an opposite accelerating structure; and a target and refocusing magnets to refocus the spent beam are located between the two linacs. A first advantage of this configuration is that the spent beam of one linac powers the RF for the other linac, and the accelerator lattice does not require a return lattice. Another advantage is that there is no high energy-low energy merge or separation, as needed for recycling ERLs. Therefore, the spent beam can be drawn down to very low energy which increases the energy efficiency. Yet another advantage is that there are two electron beams bombarding the target, so the isotope production is increased by a factor of two. The target for this configuration is special. The target is sandwiched between two γ-ray converters. The configuration requires refocusing elements on both sides of the target.

In accordance with features of the invention, the radio-isotopes produced include $^{99}$Mo, and $^{67}$Cu.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with features of the invention, a method and energy recovery linear accelerator are provided for producing radio-isotopes and recovering the isotopes in a continuous process. The energy recovery linac or isotope linac is a linac with an electron beam being transmitted through an isotope-producing target. The electron beam energy is recollected and re-injected into an accelerating structure.

In accordance with features of the invention, the isotope linac of the invention uses an ERL technology in which the electron beam that is transmitted through the target is recollected and re-injected into the accelerating structure. The present invention is a first use of ERLs for isotope production. One of the invention advantages is that the recollected beam transfers beam power to the injected electron beam, and reduces the amount of externally supplied RF power required to accelerate the electrons to energy. Therefore, the ERL isotope linac reduces the external RF power that is required to accelerate the electron beam to energies sufficient to induce photo-fission or transmutation. The linac accelerating structure uses superconducting RF (SRF) technology to increase the electron current up to 1 to 2 A. The SRF ERL isotope linac is compact in comparison to existing technology.

In accordance with features of the invention, because the ERL recycles the electron beam energy after the target, the ERL isotope linac advantageously is able to operate at a lower voltage than a comparable non-ERL isotope linac. Therefore, the ERL isotope linac has the advantage of being more compact than conventional linacs. In conventional isotope linacs, the electron beam is typically accelerated to ~50 MV. This is to create enough bremsstrahlung γ-rays with energy to induce photo-fission. Typically, there is a photo-fission resonance at photon energies between 15 and 25 MV. In conventional isotope linacs, the 50 MV beam is totally absorbed in the photon converters and thick target. In the ERL isotope linac, the optimal electron energy is nominally 22 MV, and most of the ERL beam is transmitted through the thin converter. The energy loss is kept small to enable energy recovery of the spent beam. There is little advantage to increase the beam energy above an energy that creates the γ-rays for photo-fission at resonance, since supplemental energy can be recovered rather than wasted in the target in an attempt to improve conversion efficiencies.

Figure 1:
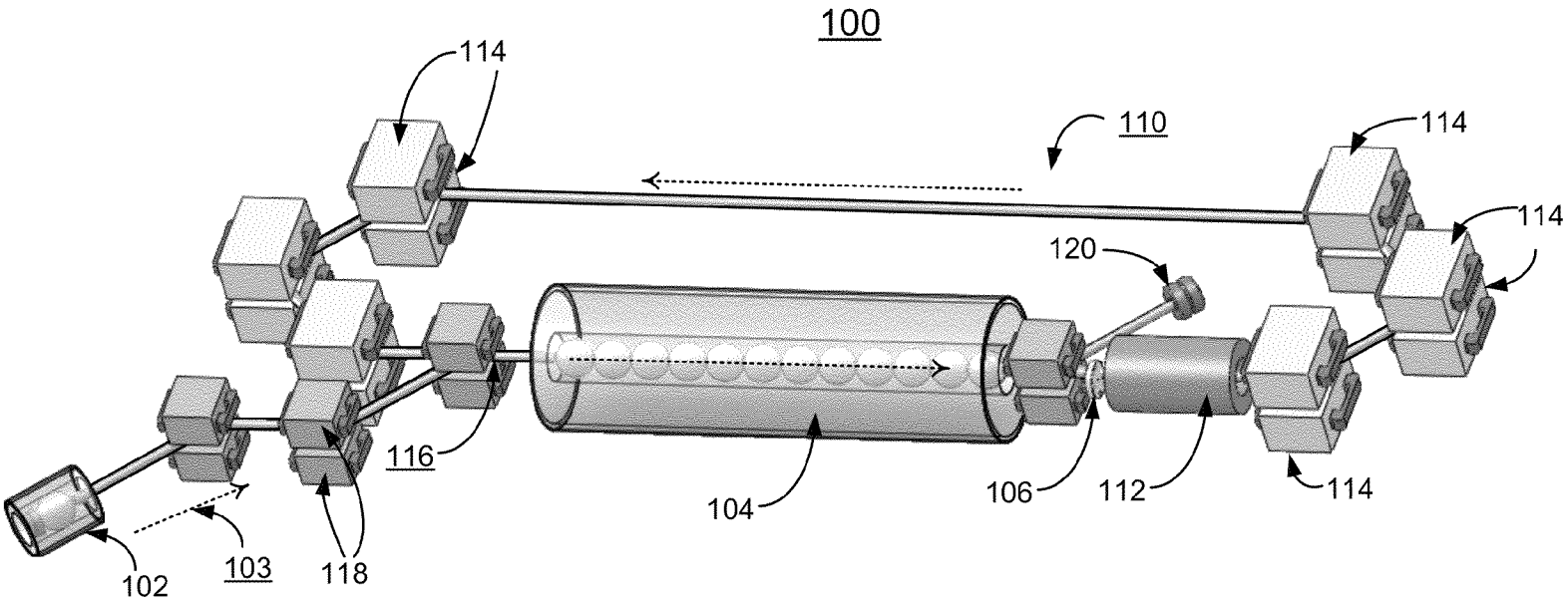
FIG. 1 schematically illustrate not to scale an exemplary ERL system for isotope production with return lattice in accordance with a preferred embodiment.
Figure 2:
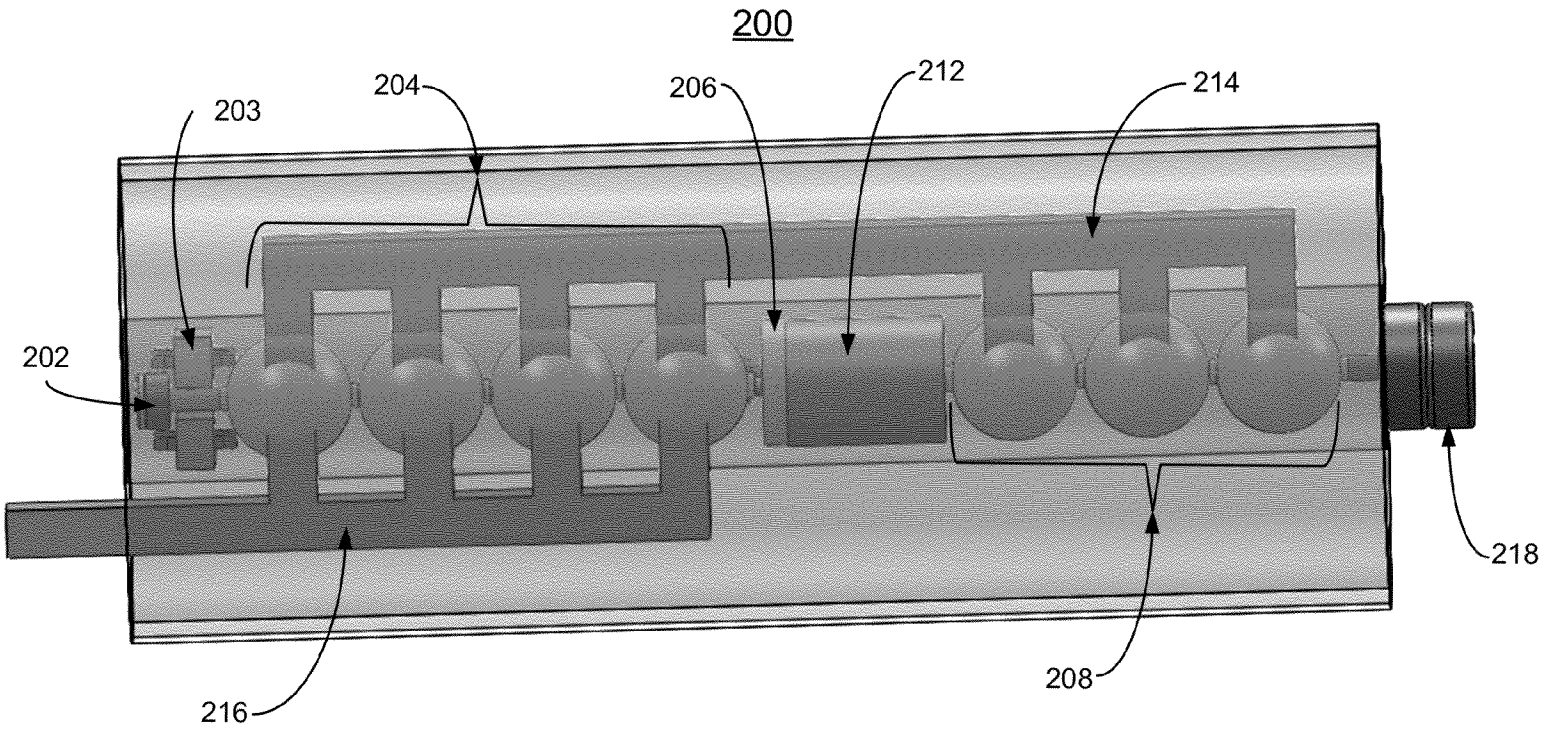
FIG. 2 schematically illustrate not to scale an exemplary ERL system for isotope production using a re-entrant linac configuration in accordance with a preferred embodiment.
Figure 3:
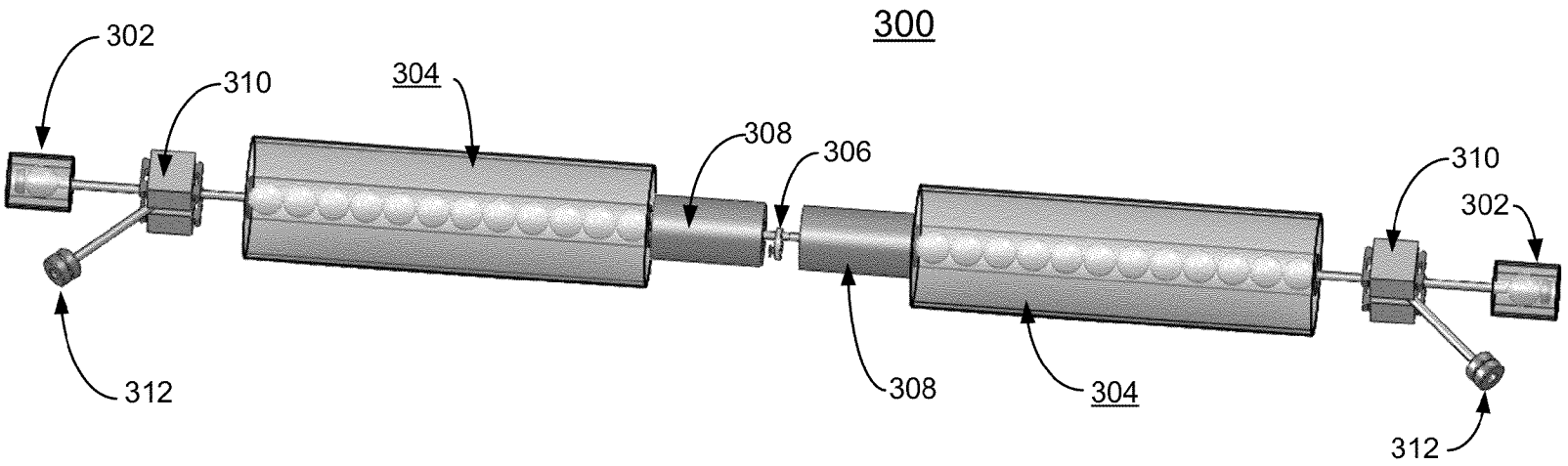
FIG. 3 schematically illustrate not to scale an exemplary ERL system for isotope production using two in-line linacs in accordance with a preferred embodiment.

In accordance with features of the invention, several accelerator lattices for energy recovery are provided that advantageously can be used with the isotope production ERL system, as illustrated and described with respect to FIGS. 1, 2, and 3. Each of the ERL configurations of the invention provides advantages over conventional isotope linacs.

In accordance with features of the invention, in each isotope production ERL system, as illustrated and described with respect to FIGS. 1, 2, and 3, the isotope-producing target is introduced into the linac through a vacuum loadlock.

In accordance with features of the invention, an activated target is removed from the target chamber and a new target installed without breaking vacuum or stopping the linac operation. This ability provides a semi-continuous or continuous feed and improves isotope recovery times. The activated target will require robotic control, using well established technology.

A first ERL configuration includes a generally conventional ERL layout, which consists of an electron gun, accelerating structure, and target; then a beam lattice recycles the spent beam to the entrance of the accelerating structures to recover the RF power as illustrated and described with respect to FIG. 1.

Having reference now to the drawings, in FIG. 1, there is shown an example electron ERL system for isotope production with return lattice generally designated by the reference character 100 in accordance with a preferred embodiment. ERL system 100 includes an electron gun 102 with electrons are produced at a cathode. The cathode can be a thermionic cathode, photo-cathode, field emission cathode, or other.

The electrons are transported through an injection lattice generally designated by reference character 103 into a linac structure 104, having an optimal electron energy, for example, ~22 MV beam energy.

The electrons are accelerated in the linear accelerator (linac) or RF resonant cavity 104. The linac accelerating structure 104 preferably is a superconducting radio frequency (RF) cavity providing the highest electron current.

It should be understood that a copper linac can also be used for the isotope ERL system 100; however, the beam current would be limited, as the copper structures require significant RF power to sustain the accelerating gradient. Because the surface electrical resistance is immensely higher than the SRF surface resistance, the copper structures will have significant ohmic heating, limiting the duty cycle and thus the average beam current.

ERL system 100 includes an isotope producing target 106. The electrons are focused onto the isotope target 106. The isotope target 106 is continuously feed into and out of the electron beam. The isotope-producing target 106 is introduced into the ERL system 100 through a vacuum loadlock so that an activated target is removed from the target chamber and a new target installed without breaking vacuum or stopping the linac operation.

ERL system 100 includes an energy recovery return lattice generally designated by reference character 110. The return lattice 110 includes a refocusing element 112. The refocusing element 112, such as a solenoid magnet captures the electrons after they pass through the target 106. The electrons are thereafter referred to as the spent beam. The recycled beam lattice 110 includes focusing elements 114 transporting the recycled spent beam to an entrance 116 of the accelerating structure 104. The recycled spent beam is merged with the electron beam coupled by focusing elements 118 of the injection lattice 103 at the entrance 116 of the accelerating structure 104. The recycled spent beam is merged with the injected electron beam to be transported through the linac accelerating structure 104. By selecting the proper phase advance and delay, the injected beam is accelerated and the spent beam is decelerated in the linac. At the exit of the linac 104, the injected beam is separated from the spent beam and focused on the target 106. The depleted spent beam is focused into a beam dump 120.

This recycled beam lattice 110 enables a simple isotope target design. The target 106 includes a single γ-ray converter together with thin isotope target 106. The γ-ray converter has a thickness that is determined by the energy acceptance for the accelerating structure 104. The primary electron beam loses only a small amount of energy when transmitted through the target 106, and it is then collected and re-focused into an accelerator lattice that transports the beam to be re-injected into the accelerating structure. The beam energy, target thickness, and recovered power are optimized to maximize isotope yield. The radio-isotopes produced, for example include $^{99}$Mo, and $^{67}$Cu.

Referring to FIG. 2, there is shown another ERL system for isotope production using a re-entrant linac configuration generally designated by the reference character 200 in accordance with a preferred embodiment.

ERL system 200 includes an in-line ERL with a simplified injection lattice. ERL system 200 includes a cathode or superconducting electron gun 202 that produces an electron beam coupled by a steering magnet 203 to a first superconducting resonant RF cavity or first linac 204. The beam is injected into the first linac 204, accelerated to ~22 MV, and focused onto an isotope target 206. The spent beam from the first linac 204 is collected and injected by a refocusing element 212, such as a solenoid magnet 214 into the second decelerating linac 208. An RF Power return 210 returns the recovered RF power to the first superconducting resonant RF cavity or first linac 204 with an input RF power 216 to the first linac 204. The depleted spent beam from the second linac 208 is exhausted in a beam dump 218.

In ERL system 200, the isotope-producing target 206 is introduced into the ERL system 200 through a vacuum loadlock so that an activated target is removed from the target chamber and a new target installed without breaking vacuum or stopping the linac operation.

The configuration ERL system 200 provides an advantage that the beam return lattice 110 of ERL system 100 is eliminated. The accelerator physics to maintain the electron beam's emittance and phase through the return lattice 110 is complex. The in-line beam recovery of ERL system 200 simplifies the beam transport and the ability to recover the electron beam. This in-line configuration of ERL system 200 provides another advantage. In ERL system 200, there are no merge or separation optics. Therefore, the spent beam can be drawn down to very low energy, thereby increasing the energy recovery efficiency of the ERL system 200. The configuration of ERL system 200 requires the refocusing element 212, such as a solenoid magnetic lens because the electron beam scatters as it passes through the target 206, so the beam divergence increases. The linac 204, 208 are longer in the configuration of ERL system 200 than with the linac 104 of ERL system 100 since there are two linac structures. However, ERL system 200 still has a smaller total area, since the return lattice 110 of ERL system 100 requires significant space.

Referring to FIG. 3, there is shown another ERL system for isotope production using two in-line linacs generally designated by the reference character 300 in accordance with a preferred embodiment.

ERL system 300 uses a pair of electron guns 302, with each electron gun 302 including a cathode and resonant RF cavity. ERL system 300 includes a pair of opposing accelerating structures or linacs 304 coupled to the isotope producing target 306, with one respective electron gun 302 coupled to each respective accelerating structure 304. The energy recovery structure includes a pair refocusing elements 308, such as a pair of solenoid magnets 308 coupled to each side of the target 306. Each respective refocusing element 308 captures electrons of a spent beam after passing through the isotope-producing target 306, and each recycled spent beam is decelerated in the opposing accelerating structure and its energy recovered. The depleted spend beam is separated by a steering magnet 310 and exhausted into a beam dump 312.

In operation of ERL system 300, the beam is transported through the simple merge element 310 and then accelerated in the respective linac 304, and focused on the isotope target 306. The spent beam is refocused by the respective solenoid magnet 308 and injected into the opposite linac 304. By proper phase advance and delay, the injected beam is accelerated, and the spent beam is decelerated to recover the RF power. The depleted beam is separated from the injected beam and exhausted in the respective beam dump 312. In ERL system 300, the isotope-producing target 306 is introduced into the ERL system 300 through a vacuum loadlock so that an activated target is removed from the target chamber and a new target installed without breaking vacuum or stopping the linac operation.

An advantage of the configuration of ERL system 300 is that the spent beam of one linac 304 powers the RF for the other linac 304. So the accelerator lattice of ERL system 300 does not require a return lattice. ERL system 300 also has the advantage that there is no high energy-low energy merge or separation, as needed for recycling ERLs. Therefore, the spent beam of ERL system 300 can be drawn down to very low energy which increases the energy efficiency. Another advantage of ERL system 300 is that there are two electron beams bombarding a target 306, so the isotope production is increased by a factor of two. The target 306 for this configuration of ERL system 300 is special. The target 306 is sandwiched between two γ-ray converters with refocusing elements 308 on both sides of the target.

Nuclear Physics of ERL Isotope Photo-Fission Efficiency Calculations

When a fast electron passes close to an atomic nucleus, there is a chance the trajectory of the electron will be perturbed, resulting in the emission of a photon. The photons generated in this manner are known as bremsstrahlung radiation. One characteristic of bremsstrahlung is that the energy spectrum of the radiation extends all the way up to the initial energy of the electron. This makes bremsstrahlung one of the most accessible sources of high energy photons for applications such as x-ray imaging.

In a conventional bremsstrahlung source, photons are generated in a heavy metal target (the target is usually called a converter) made of a material such as tungsten. The range of high energy electrons in metals is greater than the range of x-rays, so the thickness of the converter can be chosen such that the electron beam is nearly stopped but the majority of the photons escape. The alternate approach embodied by this invention is to instead use a much thinner target, and to recapture the remaining kinetic energy of the electrons in the beam.

To compare the proposed approach to the traditional one, it is necessary to estimate how efficiently energy can be recovered from the spent beam. As each electron passes through the target, its energy and direction are affected, and it is the degree of these effects which determine the efficiency. At high energy, the interaction between the electrons and the converter with the most impact on the electrons is the emission of bremsstralung radiation, as the energy of the emitted photon comes at the expense of the kinetic energy of the incident electron. The next most significant interaction is collisions with atomic electrons. Here, the energy lost in any single collision is low, but the frequency of the collisions is high. Whereas bremsstrahlung collisions result in occasional, large energy loss, electron-electron collisions affect all of the electrons in the beam in a uniform way. Due to the varying number of electron-electron collisions the electrons experience, these events also impart an energy spread to the beam. The third most significant effect is elastic collisions with the atomic nuclei. Unlike the first two types of collisions, which affect the energy of the electrons but leave their direction essentially unchanged, these collisions have little effect on the energy but deflect the direction of the trajectories.

The model we use is based on the above considerations. If, when an electron emits a photon, it loses energy above a threshold energy, it is considered unrecoverable. The remaining electrons lose some average energy due to electron-electron collisions, and an energy spread is imparted to the electron energy distribution. In this model, the consequences of the average energy loss are accounted for directly, but the effect of the energy spread imparted to the beam is incorporated only indirectly through its implicit effect on the efficiency of energy recovery. The effect of angular deflections is incorporated in the same way.

We first consider bremsstrahlung emission. The probability an electron will emit a photon of a given energy is described by the bremsstrahlung cross section. Specifically, the probability a photon with energy between $k_{min}$ and $k_{max}$ will be emitted by an electron with initial energy $E_0$ passing through a target of thickness t with a density of n atoms per unit volume is $$p(t,k)=nt\int_{k_{min}}^{k_{max}}\sigma_k(k,E_0)dk$$

where $\sigma_k(k)$ is the bremsstrahlung cross section. In the electron energy range for this application, an approximation for the cross section is $$\sigma_k(k,E_0)dk = 2\frac{Z^2}{137}r_0\frac{dk}{k}\left\{\left(\frac{E_0^2+E^2}{E_0^2}-\frac{2E}{3E_0}\right)\left(\ln M(0)+1-\frac{2}{b}\tan^{-1}b\right)+\frac{E}{E_0}\left[\frac{2}{b^2}\ln(1+b^2)+\frac{4(2-b^2)}{3b^3}\tan^{-1}b-\frac{8}{3b^2}+\frac{2}{9}\right]\right\}dk$$

$$\frac{1}{M(0)}=\left(\frac{mc^2}{2E_0E}\right)^2+\left(\frac{Z^{1/3}}{C}\right)^2$$

$$b=\frac{2E_0EZ^{1/3}}{Cmc^2k}$$

Here, $E=E_0-k$ is the energy of the electron after the collision, Z is the atomic number of the target material, $r_0$ is the classical electron radius ($2.82\times10^{-13}$ cm), C=111.0 is a dimensionless constant associated with the shape of the field of the nuclei, m is the electron rest mass, and c is the velocity of light. The cross section is plotted in FIG. 4 for a tungsten target at several initial electron energies.

Because of the broad spectrum of bremsstrahlung radiation, in order to determine the probability an electron passing through the target will result in a fission event, the bremsstrahlung photon spectrum must be convolved with the probability of fission as a function of photon energy. This latter function, however, is sharply peaked at a certain photon energy (the giant dipole resonance, or GDR), and the contribution from photons near this peak effectively determines the probability of fission. Therefore, to a good approximation, the probability is determined by the intensity of the bremsstrahlung radiation near this energy. In the case of uranium, the peak of the GDR lies at approximately 15 MeV. The probability of photon emission in a narrow energy range Δk near 15 MeV is $$\text{probability}=Nnt\times\sigma_k(15\text{ MeV},E_0)\times\Delta k.$$

By taking this probability to be linear in target thickness, we have assumed the probability that a single electron will emit multiple high energy photons is negligible, which is true for the target thicknesses we will consider As described above, emission of photons far from the GDR peak are not likely to cause fission, but if the photon energy is greater than a small percentage of the electron energy, it is effectively impossible to recover the remaining energy of the electron. If the photon energy $k_T$ marks the maximum energy of photon emission where we may neglect the effect on the electron, the probability an electron will be "lost" is determined from the bremsstrahlung cross section by $$p_B(t,k_T,E_0)=nt\int_{k_T}^{E_0}\sigma_k(k,E_0)dk.$$

We next turn to electron-electron collisions. For high energy electrons, energy loss due to these events is of a lower magnitude than radiation losses. At some energy, which depends on the properties of the target material, the relative significance of the two phenomena switches. Although the electron energy range appropriate for this application lies above that point, the effect of electron-electron collisions are not necessarily insignificant. Applying the theory of electron-electron collisions, the average energy loss per unit distance due to this mechanism is $$-\frac{dE}{dz}=2\pi r_0^2mc^2Zn\ln\left(\frac{E^3}{2mc^2I^2Z^2}\right)$$

The constant I is associated with the ionization potential of the target material. We take I to be 13.5 eV, as an approximation where it is effectively a requirement for energy recovery that the energy lost by the beam is small compared to the energy in the beam, in other words, $\Delta E<<E_0$. Over these small ranges of E, dE/dz is nearly constant, so $$\Delta E\approx\left[\frac{dE}{dz}\right]_{E=E_0}\times t$$

Figure 5:
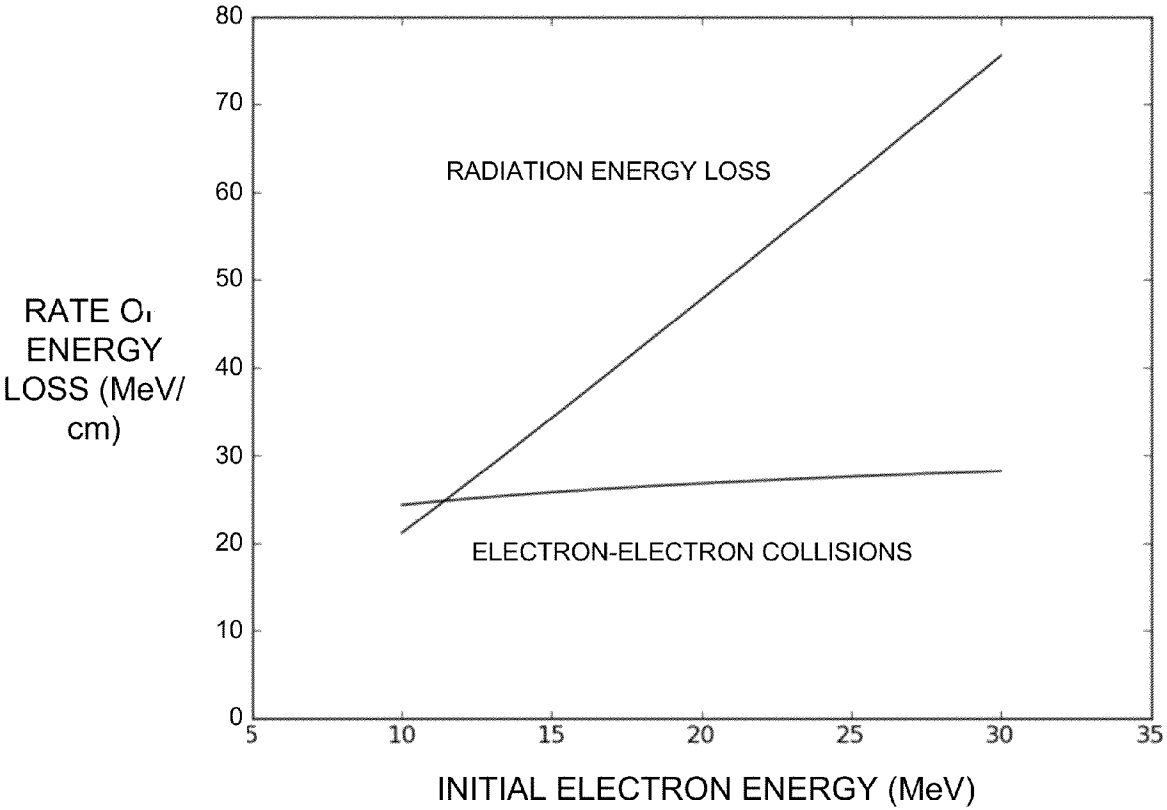
FIG. 5 is a chart illustrating energy loss due to electron-electron collisions for comparison to energy loss due to radiation in accordance with a preferred embodiment.

In FIG. 5, energy loss due to electron-electron collisions is compared to the rate energy is lost in the form of bremsstrahlung emission, $n\int_0^{E_0}k\times\sigma_k(k,E_0)dk$. The optimum initial electron energy for this application will be shown below to be near 20 MeV.

If a beam consists of N electrons, each with an initial energy of $E_0$, the initial energy of the beam is $NE_0$. Rewriting the probability of energy loss due to emission of a high energy photon as $p_B=\rho_B t$ and the average energy loss per electron due to electron-electron collisions as $[dE/dz]_{E=E_0}=E_0\alpha_e$, the energy remaining in the beam after passing through the target is $(N-N\rho_B t)(E_0-\alpha E_0 t)$.

Next, the efficiency of energy recovery must be considered. The amount of energy that can be recovered depends on the details of the implementation. We therefore incorporate the effect of energy recovery efficiency as an independent parameter R, the ratio of the energy that can be recovered to the total energy remaining in the spent beam. The net energy spent on a single pass is then $NE_0-R(N-N\rho_B t)(E_0-\alpha_e E_0 t)$, or equivalently $$\text{energy spent}=NE_0[1-R(1-\rho_B t)(1-\alpha_e t)]$$

Optimally, the thickness of the thin target will be chosen such that the energy loss on a single pass is small compared to the total energy in the beam, so $N\rho_B t<<N$, or $\rho_B t<<1$, and $\alpha_e E_0 t<<E_0$, or $\alpha_e t<<1$. Expanding the terms in parenthesis and ignoring the small quadratic term, $$\text{energy spent}\approx NE_0[1-R(1-\rho_B t-\alpha_e t)].$$

The efficiency, representative of useful photons generated per unit of energy spent, is therefore $$\text{efficiency}=\frac{Nnt\sigma_k(15\text{ MeV},E_0)\Delta_k}{NE_0[1-R(1-\rho_B t-\alpha_e t)]}$$

This expression can be reformulated in a way that makes the dependence on the parameters clearer in the following way. Replacing R by 1−r and $\rho_B-\alpha_e$ with $\lambda$, $$\text{efficiency}=\frac{1}{E_0}n\sigma_k(15\text{ MeV},E_0)\Delta_k\left\{\frac{t}{[1-(1-r)(1-\lambda t)]}\right\}$$

Here, r and $\lambda t$ are both small compared to one, so, as above, the terms in parenthesis can be expanded, and the small term $r\times\lambda t$ can be neglected, leaving $$\text{efficiency}\approx\frac{1}{E_0}n\sigma_k(15\text{ MeV},E_0)\Delta_k\left\{\frac{t}{r+\lambda t}\right\}.$$

The expression in brackets has two limiting forms: when $r>>\lambda t$, it approaches t/r, and when $\lambda t>>r$, it approaches $1/\lambda$. Notionally, it might appear that peak efficiency is reached by making t large enough that $\lambda t>>r$, where it reaches the limit of $1/\lambda$. It must be remembered, though, that r implicitly depends on both $E_0$ and t. For example, as the target thickness is increased, the energy spread (and emittance) of the spent beam increase, reducing the fraction of the energy in the spent beam that can be recovered. What this model does provide is a rough upper bound as well as an order-of-magnitude estimate of the efficiency that can be achieved. Taking the asymptotic limit $1/\lambda$ for the term in the brackets, we have $$\text{efficiency}\le\frac{n\sigma_k(15\text{ MeV},E_0)\Delta_k}{\lambda E_0}$$

Figure 6:
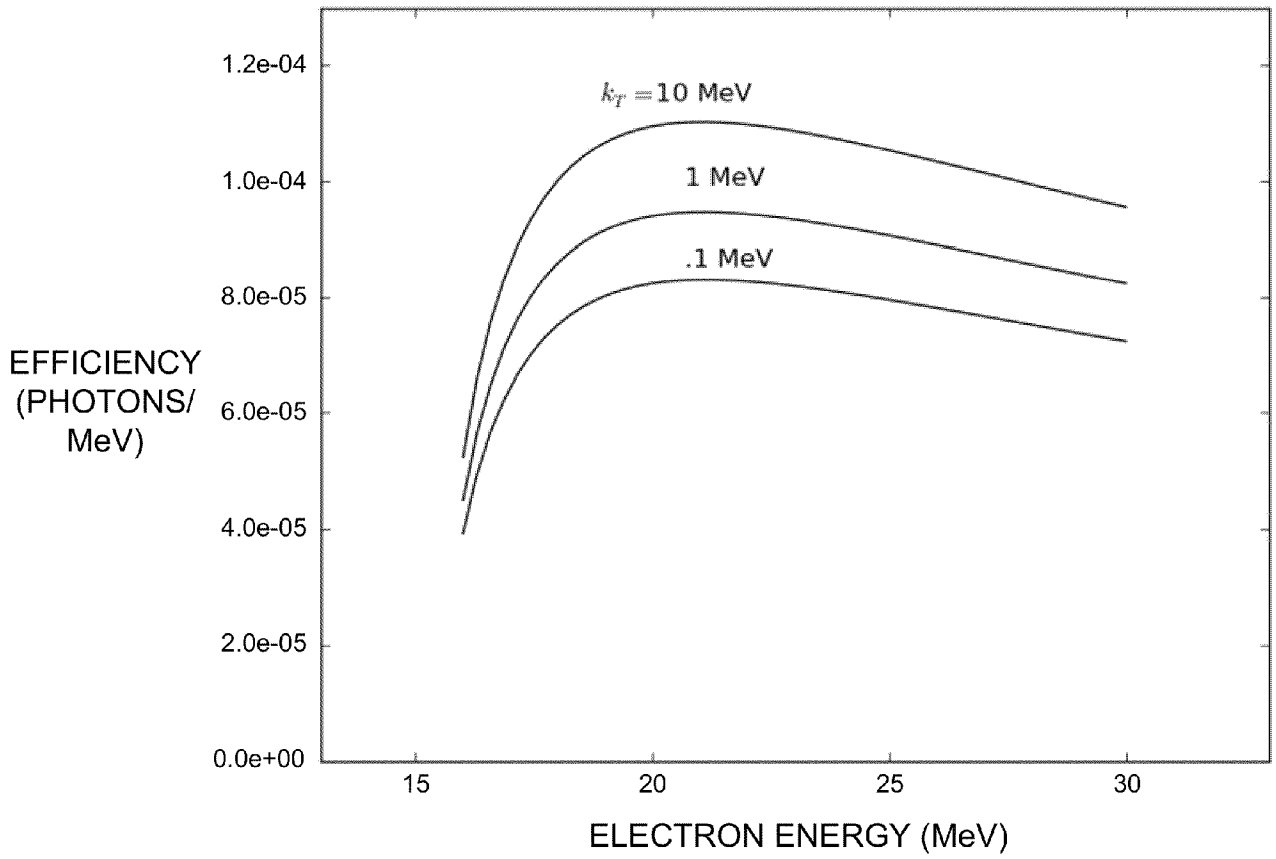
FIG. 6 is a chart illustrating maximum potential efficiency for production of photons in the 1 MeV window near 15 MeV in accordance with a preferred embodiment.

This data is plotted in FIG. 6, where, for definiteness, $\Delta_k$, the bandwidth or window of allowed photon energies around the target value (15 MeV) is taken to be 1 MeV. This range will be used below in the discussion of thick target photon production so a direct comparison can be made.

Bremsstrahlung generation using thick targets suitable for the generation of radioisotopes has been analyzed, and results reported for 30 and 60 MeV electrons incident on a thick (relative to the stopping distance for electrons) tungsten target. The 60 MeV electron energy was found to be slightly more efficient than the 30 MeV case, so we will use the 60 MeV data as a benchmark. For thick targets, the effect of electron deflection in the target on the angular distribution of radiation must be taken into account. Though still strongly peaked in the forward direction, the angular spread is greater. Whereas we have considered the spectrum integrated over angle, with reported intensity averaged over various angular ranges. The amount of useful radiation therefore depends on the maximum emission angle that can be captured. We will use, as a reference, the range of 0-5°, which is reasonably collimated and also captures the majority of the total radiation emitted. A cone defined by this 5° limit subtends $2\pi(1-\cos 5°)\approx 0.024$ sr. Berger and Seltzer found the intensity of photons in the neighborhood of 15 MeV emitted into this cone to be 0.06 $\text{MeV}^{-1}\text{ sr}^{-1}$, and for example, 0.09 $\text{MeV}^{-1}\text{ sr}^{-1}$. Using 0.1 $\text{MeV}^{-1}\text{ sr}^{-1}$ as a benchmark, the probability an electron will emit a photon with energy in the 1 MeV window near 15 MeV is thus $0.024\times0.1\times1=0.0024$ (0.24%), and the efficiency for this process is 0.0024/(60 MeV)=$4\times10^{-5}$ photons per MeV. Comparing these numbers to the results of the efficiency calculations carried out above, the energy recovery approach is likely to have higher efficiency when the beam energy lost during energy recovery is equal to or less than the energy lost due to the beam's interaction with the target.

Energy Recovery Considerations

Energy recovery efficiency is limited by the energy spread of the spent beam. The energy spread, or straggling, induced on the beam by its interactions with the target are primarily caused by bremsstrahlung emission and collisions with atomic electrons. Bremsstrahlung emission results in a long tail on the energy distribution. Electron-electron collisions induce a Gaussian distribution due to a statistically large number of less violent collisions, as well as a tail due to less frequent but more violent collisions. Here, we will neglect the tail, because bremsstrahlung emission is the dominant source of large energy loss. The standard deviation of the Gaussian peak is given by $$\Omega=\sqrt{4\pi NZr_0^2}\times mc^2\times\sqrt{t}$$

If we consider, as an example, an initial beam energy of 20 MeV, a target thickness of 250 μm would result in a mean energy loss of approximately 2 MeV (see FIG. 8)—an energy loss of this magnitude would strain the validity of our approximations. Even then, the width of the peak ($2\times\Omega$) is just 0.34 eV, or 1.7%, well within the range that can be accepted using existing energy recovery technology. In fact, it appears further efficiency could be gained by optimizing the energy recovery for this application, specifically, by decelerating the beam to a lower final energy.

Figure 4:
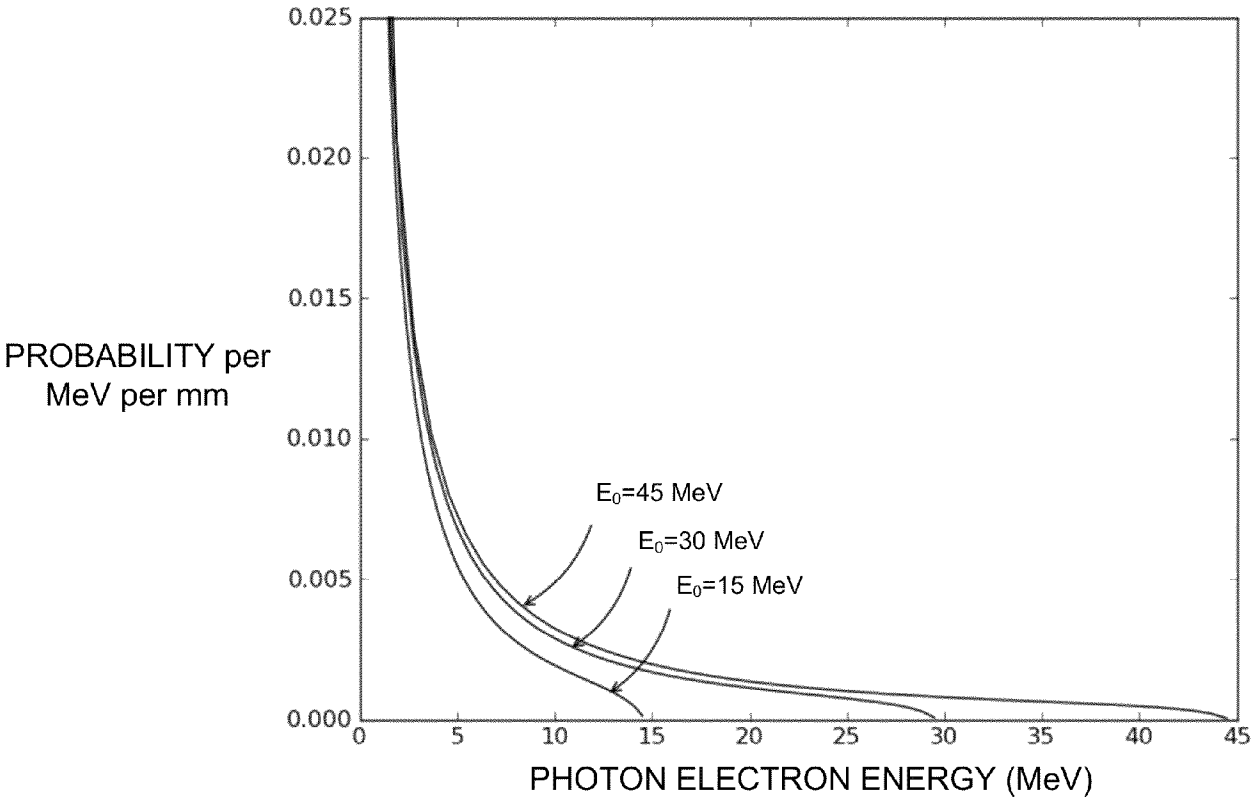
FIG. 4 is a chart illustrating probability, per MeV of photon bandwidth, per millimeter traveled in the material, that an electron will emit a photon at a given energy in accordance with a preferred embodiment.

FIG. 4 is a chart illustrating probability, per MeV of photon bandwidth, per millimeter traveled in the material, that an electron will emit a photon of a given energy in accordance with a preferred embodiment with probability per MeV per millimeter shown relative to the vertical axis and photon electron energy per MeV shown relative to the horizontal axis. The photofission cross section for uranium peaks at about 15 MeV. It is seen that the probability for the generation of a photon at a given energy rises rapidly as the electron energy exceeds the photon energy, then levels off.

FIG. 5 is a chart illustrating energy loss due to electron-electron collisions for comparison to energy loss due to radiation in accordance with a preferred embodiment with rate of energy loss in MeV per centimeter shown relative to the vertical axis and initial energy per MeV shown relative to the horizontal axis. At low energy, electron-electron collisions are the primary energy loss mechanism, whereas at higher energy bremsstrahlung emission due to interaction with the massive nuclei becomes dominant.

FIG. 6 is a chart illustrating Maximum potential efficiency for production of photons in the 1 MeV window near 15 MeV in accordance with a preferred embodiment based on the simplified model described above. The efficiency that can be achieved in practice is dependent on the implementation of the energy recovery. As a result, peak efficiency may not occur at the crest of the curve. For conventional photofission production, the efficiency is on the order of $4\times10^{-5}$ photons per MeV of beam energy.

While the present invention has been described with reference to the details of the embodiments of the invention shown in the drawing, these details are not intended to limit the scope of the invention as claimed in the appended claims.

What is claimed is:

1. A isotope linac system for producing radio-isotopes comprising:

an isotope linac comprising an energy recovery linac (ERL);

an electron beam being transmitted through an isotope-producing target; said isotope-producing target having a thickness where the energy loss on a single pass through an isotope-producing target is substantially less than the total energy in the electron beam; and energy recovery structure recollecting electron beam energy transmitted through said isotope-producing target and injecting the recollected electron beam into an accelerating structure; said energy recovery structure enabling operation of the isotope linac system, reducing beam voltage, and increasing beam current without increasing the external power consumption.

2. The isotope linac system as recited in claim 1 includes a superconducting radio frequency (RF) electron gun.

3. The isotope linac system as recited in claim 1 wherein said accelerating structure includes a superconducting RF (SRF) linac accelerating structure.

4. The isotope linac system as recited in claim 1 wherein said energy recovery structure includes a recycled beam lattice.

5. The isotope linac system as recited in claim 4 wherein said isotope-producing target used with said recycled beam lattice includes a single γ-ray converter to create gamma radiation.

6. The isotope linac system as recited in claim 5 wherein said single γ-ray converter having a thickness determined by an energy acceptance for the accelerating structure and said single γ-ray converter having said thickness to create gamma radiation required for photo-fission of said isotope-producing target.

7. The isotope linac system as recited in claim 4 wherein said recycled beam lattice includes a refocusing element capturing electrons of a spent beam after passing through said isotope-producing target, and said recycled beam lattice transporting said recycled spent beam to an entrance of said accelerating structure, and merging said recycled spent beam with said electron beam.

8. The isotope linac system as recited in claim 7 wherein said refocusing element includes a solenoid magnet coupled to said target, and wherein said accelerating structure includes a superconducting RF (SRF) linac accelerating structure.

9. The isotope linac system as recited in claim 7 wherein said recycled spent beam is decelerated in said accelerating structure and depleted, and said depleted spend beam focused into a beam dump.

10. The isotope linac system as recited in claim 1 wherein said energy recovery structure includes a second accelerating structure; a refocusing element capturing electrons of a spent beam after passing through said isotope-producing target, and said second accelerating structure decelerates said spent beam, recovering radio frequency (RF) power.

11. The isotope linac system as recited in claim 10 wherein said second accelerating structure is disposed in-line with said accelerating structure; and wherein said refocusing element includes a solenoid magnet coupled to said target.

12. The isotope linac system as recited in claim 10 wherein said depleted spend beam from said second accelerating structure is exhausted in a beam dump.

13. The isotope linac system as recited in claim 1 includes a pair of opposing accelerating structures, and a pair of electron guns, each electron gun coupled to a respective accelerating structure, and wherein said energy recovery structure includes a pair of refocusing elements coupled to each side of said target; each respective refocusing element capturing electrons of a spent beam after passing through said isotope-producing target.

14. The isotope linac system as recited in claim 13 wherein each said recycled spent beam is decelerated in said opposing accelerating structure and depleted, and said depleted spend beam focused into a beam dump.

15. The isotope linac system as recited in claim 13 wherein said isotope-producing target being used with said energy recovery structure with said pair of opposing accelerating structures includes a pair of γ-ray converters and said isotope producing target disposed between said γ-ray converters.

* * * * *